US010117311B2

(12) United States Patent
Battaglia

(10) Patent No.: US 10,117,311 B2
(45) Date of Patent: Oct. 30, 2018

(54) AUTOMATIC POWER CONTROLLER FOR A PLURALITY OF LIGHTING ARRAYS

(71) Applicant: Phoseon Technology, Inc., Hillsboro, OR (US)

(72) Inventor: Salvatore T. Battaglia, Vancouver, WA (US)

(73) Assignee: Phoseon Technology, Inc., Hillsboro, OR (US)

( * ) Notice: Subject to any disclaimer, the term of this patent is extended or adjusted under 35 U.S.C. 154(b) by 78 days.

(21) Appl. No.: 15/012,049

(22) Filed: Feb. 1, 2016

(65) Prior Publication Data

US 2017/0223804 A1 Aug. 3, 2017

(51) Int. Cl.

| | |
|---|---|
| ***H05B 37/02*** | (2006.01) |
| ***F21V 29/70*** | (2015.01) |
| ***F21V 5/00*** | (2018.01) |
| ***F21V 7/00*** | (2006.01) |
| ***F21V 23/04*** | (2006.01) |
| ***F21V 33/00*** | (2006.01) |
| ***H05B 33/08*** | (2006.01) |
| *F21Y 115/10* | (2016.01) |

(52) U.S. Cl.

CPC ..... *H05B 37/0227* (2013.01); *F21V 5/004* (2013.01); *F21V 7/0083* (2013.01); *F21V 23/04* (2013.01); *F21V 29/70* (2015.01); *F21V 33/0092* (2013.01); *H05B 33/0845* (2013.01); *F21Y 2115/10* (2016.08)

(58) Field of Classification Search

CPC ..... H05B 37/0227; H05B 33/0845

See application file for complete search history.

(56) References Cited

U.S. PATENT DOCUMENTS

| | | | | |
|---|---|---|---|---|
| 7,423,387 | B2 | 9/2008 | Robinson et al. | |
| 7,576,525 | B2 | 8/2009 | So et al. | |
| 7,777,430 | B2 | 8/2010 | Catalano et al. | |
| 9,109,777 | B2 | 8/2015 | Childers | |
| 2006/0109219 | A1* | 5/2006 | Robinson | G09G 3/14 345/83 |
| 2007/0171159 | A1 | 7/2007 | Lee | |
| 2008/0130288 | A1 | 6/2008 | Catalano et al. | |
| 2010/0141159 | A1 | 6/2010 | Shiu et al. | |
| 2012/0306370 | A1* | 12/2012 | Van De Ven | H05B 33/0866 315/113 |
| 2014/0197735 | A1* | 7/2014 | Kornitz | F21V 29/02 315/113 |

(Continued)

FOREIGN PATENT DOCUMENTS

EP 2861043 A2 4/2015

OTHER PUBLICATIONS

ISA Korean Intellectual Property Office, International Search Report and Written Opinion Issued in Application No. PCT/US2017/014780, dated May 8, 2017, WIPO, 10 pages.

*Primary Examiner* — Seokjin Kim

(74) *Attorney, Agent, or Firm* — McCoy Russell LLP

(57) ABSTRACT

Systems and methods for operating one or more light emitting devices in a lighting array are disclosed. In one example, two or more negative temperature coefficient devices are electrically coupled in parallel so that a plurality of independently controlled lighting arrays may be controlled via a single amplifier. The two or more negative temperature coefficient devices are positioned in a negative feedback loop of the single amplifier.

3 Claims, 5 Drawing Sheets

(56) References Cited

U.S. PATENT DOCUMENTS

| | | | | |
|---|---|---|---|---|
| 2015/0108908 | A1 | 4/2015 | Denvir | |
| 2015/0233566 | A1* | 8/2015 | Catalano ..... | H05B 33/0854 362/373 |

* cited by examiner

AUTOMATIC POWER CONTROLLER FOR A PLURALITY OF LIGHTING ARRAYS

BACKGROUND/SUMMARY

A photoreactive system may include a solid-state lighting array to curing photo sensitive media such as coatings, including inks, adhesives, preservatives, etc. Curing time of these photo sensitive media may be responsive to solid-state lighting array irradiance output. Further, solid-state lighting array irradiance output may be influenced by temperatures of solid-state lighting devices that make up the solid-state lighting array. Therefore, if the solid-state lighting devices operate at temperatures away from their nominal operating temperature, photo sensitive media may not cure sufficiently or electrical power consumption may increase due to changes in solid-state light device irradiance levels. Additionally, the solid-state lighting devices may be in thermal communication with a heat sink to control solid-state lighting device temperature. However, the heat sink may have several temperature zones that vary in temperature from other temperature zones of the heat sink. Consequently, some solid-state lighting devices in the solid-state lighting array may operate at different temperatures than other solid-state lighting devices in the solid-state lighting array. As a result, irradiance output from one area of the lighting array may vary more than is desired from irradiance output from a different area of the lighting array, especially if the lighting arrays are operated independently.

The inventor herein has recognized the above-mentioned disadvantages and has developed a system for operating one or more light emitting devices, comprising: at least two independently controlled lighting arrays comprised of at least one light emitting device; and an amplifier including a negative feedback loop, at least two negative temperature coefficient devices electrically coupled in parallel and included in the negative feedback loop, each of the at least two negative temperature coefficient devices in thermal communication with one of the at least two independently controlled lighting arrays.

By electrically coupling two or more negative temperature coefficient devices in parallel and in a negative feedback loop of an amplifier that controls current flow through one or more light emitting devices, it may be possible to control irradiance output of two or more lighting arrays in a photoreactive system with a single amplifier. The inventor has recognized that one negative temperature coefficient device in a parallel electrical circuit with other negative temperature coefficient devices may dominate determination of amplifier gain such that amplifier gain is more influenced by the one negative temperature coefficient device than other negative temperature coefficient devices in the parallel electrical circuit when a lighting array monitored by the one negative temperature coefficient device is active while other lighting arrays monitored by other negative temperature coefficient devices are inactive. Consequently, the amplifier gain may be appropriate for the activated lighting array monitored by the one negative temperature coefficient device. In one example, two or more negative temperature coefficient devices are in thermal communication with two or more lighting arrays via a heat sink. The temperatures sampled at the heat sink via the two or more negative temperature coefficient devices supply temperature feedback for the individual lighting arrays to the amplifier so that irradiance of each lighting array may be controlled to provide a desired level of irradiance for the photoreactive system.

The present description may provide several advantages. Specifically, the approach may improve lighting system light intensity control. Additionally, the approach may provide feedback control for more than two independently controlled lighting arrays via a single amplifier. Further, the approach may provide more consistent curing of photo sensitive media.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
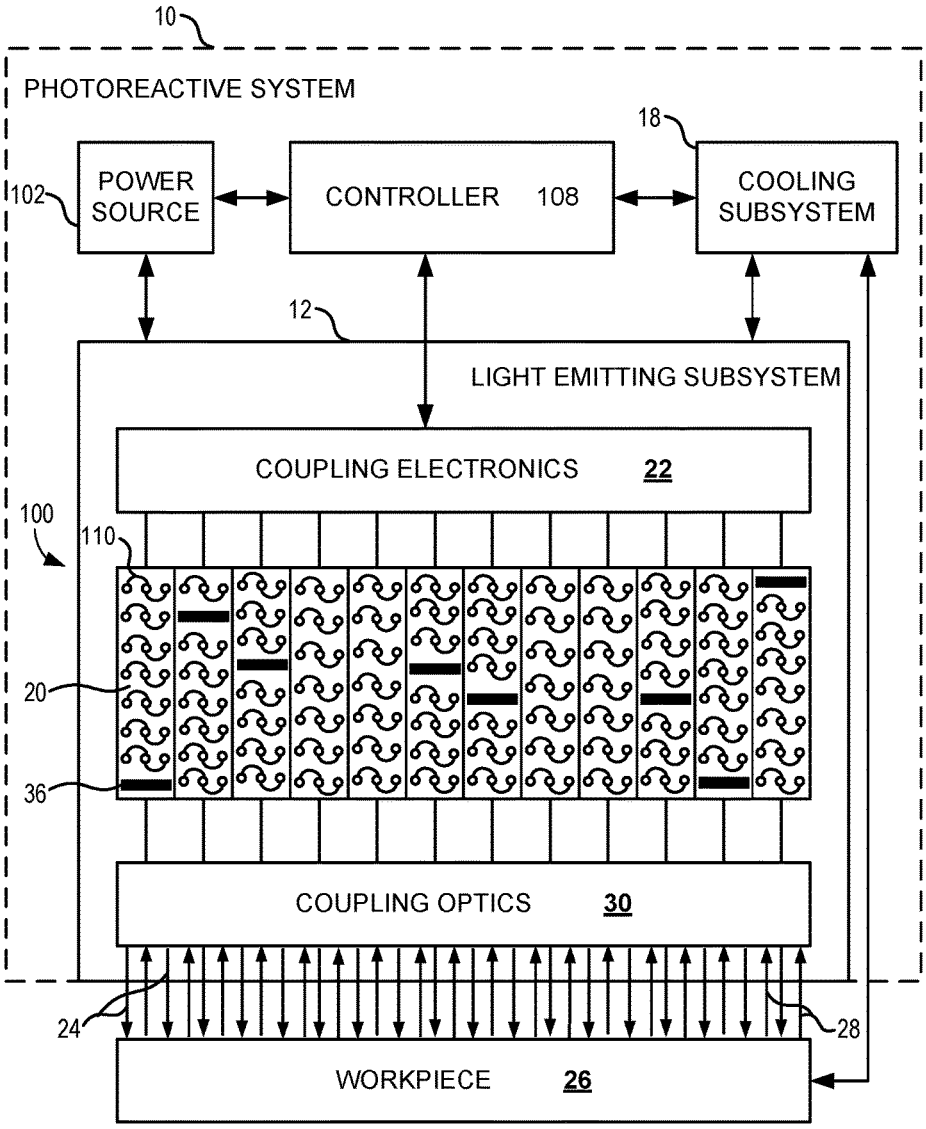
FIG. 1 shows a schematic depiction of a lighting system.

The present description is related to a lighting system that outputs a substantially constant (e.g., ±5%) irradiance level. FIG. 1 shows one example lighting system that includes a sole amplifier to control irradiance output of two or more independently controlled lighting arrays. The lighting array irradiance control may be provided via the example circuits shown in FIGS. 2 and 3. The lighting system may operate according to the plots of FIG. 4. A method for operating a lighting system to provide substantially constant irradiance is shown in FIG. 5. Electrical interconnections shown between components in the various electrical diagrams represent current paths between the illustrated devices.

Referring now to FIG. 1, a block diagram of a photoreactive system 10 in accordance with the system and method described herein is shown. In this example, the photoreactive system 10 comprises a lighting subsystem 100, a controller 108, a power source 102 and a cooling subsystem 18.

The lighting subsystem 100 may comprise a plurality of light emitting devices 110. Light emitting devices 110 may be LED devices, for example. Selected of the plurality of light emitting devices 110 are implemented to provide radiant output 24. The radiant output 24 is directed to a work piece 26. Returned radiation 28 may be directed back to the lighting subsystem 100 from the work piece 26 (e.g., via reflection of the radiant output 24).

The radiant output 24 may be directed to the work piece 26 via coupling optics 30. The coupling optics 30, if used, may be variously implemented. As an example, the coupling optics may include one or more layers, materials or other structure interposed between the light emitting devices 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor device providing radiant output 24 may be disposed in a respective micro-reflector, on a one-to-one basis.

Each of the layers, materials or other structure may have a selected index of refraction. By properly selecting each index of refraction, reflection at interfaces between layers, materials and other structure in the path of the radiant output 24 (and/or returned radiation 28) may be selectively controlled. As an example, by controlling differences in such indexes of refraction at a selected interface disposed between the semiconductor devices to the work piece 26, reflection at that interface may be reduced, eliminated, or minimized, so as to enhance the transmission of radiant output at that interface for ultimate delivery to the work piece 26.

The coupling optics 30 may be employed for various purposes. Example purposes include, among others, to protect the light emitting devices 110, to retain cooling fluid associated with the cooling subsystem 18, to collect, condense and/or collimate the radiant output 24, to collect, direct or reject returned radiation 28, or for other purposes, alone or in combination. As a further example, the photoreactive system 10 may employ coupling optics 30 so as to enhance the effective quality or quantity of the radiant output 24, particularly as delivered to the work piece 26.

Selected of the plurality of light emitting devices 110 may be coupled to the controller 108 via coupling electronics 22, so as to provide data to the controller 108. As described further below, the controller 108 may also be implemented to control such data-providing semiconductor devices, e.g., via the coupling electronics 22.

The controller 108 preferably is also connected to, and is implemented to control, each of the power source 102 and the cooling subsystem 18. Moreover, the controller 108 may receive data from power source 102 and cooling subsystem 18.

The data received by the controller 108 from one or more of the power source 102, the cooling subsystem 18, the lighting subsystem 100 may be of various types. As an example, the data may be representative of one or more characteristics associated with coupled semiconductor devices 110, respectively. As another example, the data may be representative of one or more characteristics associated with the respective component 12, 102, 18 providing the data. As still another example, the data may be representative of one or more characteristics associated with the work piece 26 (e.g., representative of the radiant output energy or spectral component(s) directed to the work piece). Moreover, the data may be representative of some combination of these characteristics.

The controller 108, in receipt of any such data, may be implemented to respond to that data. For example, responsive to such data from any such component, the controller 108 may be implemented to control one or more of the power source 102, cooling subsystem 18, and lighting subsystem 100 (including one or more such coupled semiconductor devices). As an example, responsive to data from the lighting subsystem indicating that the light energy is insufficient at one or more points associated with the work piece, the controller 108 may be implemented to either (a) increase the power source's supply of current and/or voltage to one or more of the semiconductor devices 110, (b) increase cooling of the lighting subsystem via the cooling subsystem 18 (i.e., certain light emitting devices, if cooled, provide greater radiant output), (c) increase the time during which the power is supplied to such devices, or (d) a combination of the above.

Individual semiconductor devices 110 (e.g., light emitting diode (LED) devices) of the lighting subsystem 100 may be controlled independently by controller 108. For example, controller 108 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same array of semiconductor devices 110, or may be from more than one array of semiconductor devices 110. Arrays of semiconductor devices 110 may also be controlled independently by controller 108 from other arrays of semiconductor devices 110 in lighting subsystem 100 by controller 108. For example, the semiconductor devices of a first array may be controlled to emit light of a first intensity, wavelength, and the like, while those of a second array may be controlled to emit light of a second intensity, wavelength, and the like.

As a further example, under a first set of conditions (e.g. for a specific work piece, photoreaction, and/or set of operating conditions) controller 108 may operate photoreactive system 10 to implement a first control strategy, whereas under a second set of conditions (e.g. for a specific work piece, photoreaction, and/or set of operating conditions) controller 108 may operate photoreactive system 10 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, and the different group of LED devices may include a subset of one or more LED devices from the second group.

The cooling subsystem 18 is implemented to manage the thermal behavior of the lighting subsystem 100. For example, generally, the cooling subsystem 18 provides for cooling of such subsystem 12 and, more specifically, the semiconductor devices 110. The cooling subsystem 18 may also be implemented to cool the work piece 26 and/or the space between the piece 26 and the photoreactive system 10 (e.g., particularly, the lighting subsystem 100). For example, cooling subsystem 18 may be an air or other fluid (e.g., water) cooling system.

The photoreactive system 10 may be used for various applications. Examples include, without limitation, curing applications ranging from ink printing to the fabrication of DVDs and lithography. Generally, the applications in which the photoreactive system 10 is employed have associated parameters. That is, an application may include associated operating parameters as follows: provision of one or more levels of radiant power, at one or more wavelengths, applied over one or more periods of time. In order to properly accomplish the photoreaction associated with the application, optical power may need to be delivered at or near the work piece at or above a one or more predetermined levels of one or a plurality of these parameters (and/or for a certain time, times or range of times).

In order to follow an intended application's parameters, the semiconductor devices 110 providing radiant output 24 may be operated in accordance with various characteristics associated with the application's parameters, e.g., temperature, spectral distribution and radiant power. At the same time, the semiconductor devices 110 may have certain operating specifications, which may be are associated with the semiconductor devices' fabrication and, among other things, may be followed in order to preclude destruction and/or forestall degradation of the devices. Other components of the photoreactive system 10 may also have associated operating specifications. These specifications may include ranges (e.g., maximum and minimum) for operating temperatures and applied, electrical power, among other parameter specifications.

Accordingly, the photoreactive system 10 supports monitoring of the application's parameters. In addition, the photoreactive system 10 may provide for monitoring of semiconductor devices 110, including their respective characteristics and specifications. Moreover, the photoreactive system 10 may also provide for monitoring of selected other components of the photoreactive system 10, including their respective characteristics and specifications.

Providing such monitoring may enable verification of the system's proper operation so that operation of photoreactive system 10 may be reliably evaluated. For example, the system 10 may be operating in an undesirable way with respect to one or more of the application's parameters (e.g., temperature, radiant power, etc.), any components characteristics associated with such parameters and/or any component's respective operating specifications. The provision of monitoring may be responsive and carried out in accordance with the data received by controller 108 by one or more of the system's components.

Monitoring may also support control of the system's operation. For example, a control strategy may be implemented via the controller 108 receiving and being responsive to data from one or more system components. This control, as described above, may be implemented directly (i.e., by controlling a component through control signals directed to the component, based on data respecting that components operation) or indirectly (i.e., by controlling a component's operation through control signals directed to adjust operation of other components). As an example, a semiconductor device's radiant output may be adjusted indirectly through control signals directed to the power source 102 that adjust power applied to the lighting subsystem 100 and/or through control signals directed to the cooling subsystem 18 that adjust cooling applied to the lighting subsystem 100.

Control strategies may be employed to enable and/or enhance the system's proper operation and/or performance of the application. In a more specific example, control may also be employed to enable and/or enhance balance between the array's radiant output and its operating temperature, so as, e.g., to preclude heating the semiconductor devices 110 or array of semiconductor devices 110 beyond their specifications while also directing radiant energy to the work piece 26 sufficient to properly complete the photoreaction(s) of the application.

In some applications, high radiant power may be delivered to the work piece 26. Accordingly, the subsystem 12 may be implemented using an array of light emitting semiconductor devices 110. For example, the subsystem 12 may be implemented using a high-density, light emitting diode (LED) array. Although LED arrays may be used and are described in detail herein, it is understood that the semiconductor devices 110, and array(s) of same, may be implemented using other light emitting technologies without departing from the principles of the description, examples of other light emitting technologies include, without limitation, organic LEDs, laser diodes, other semiconductor lasers.

Figure 2:
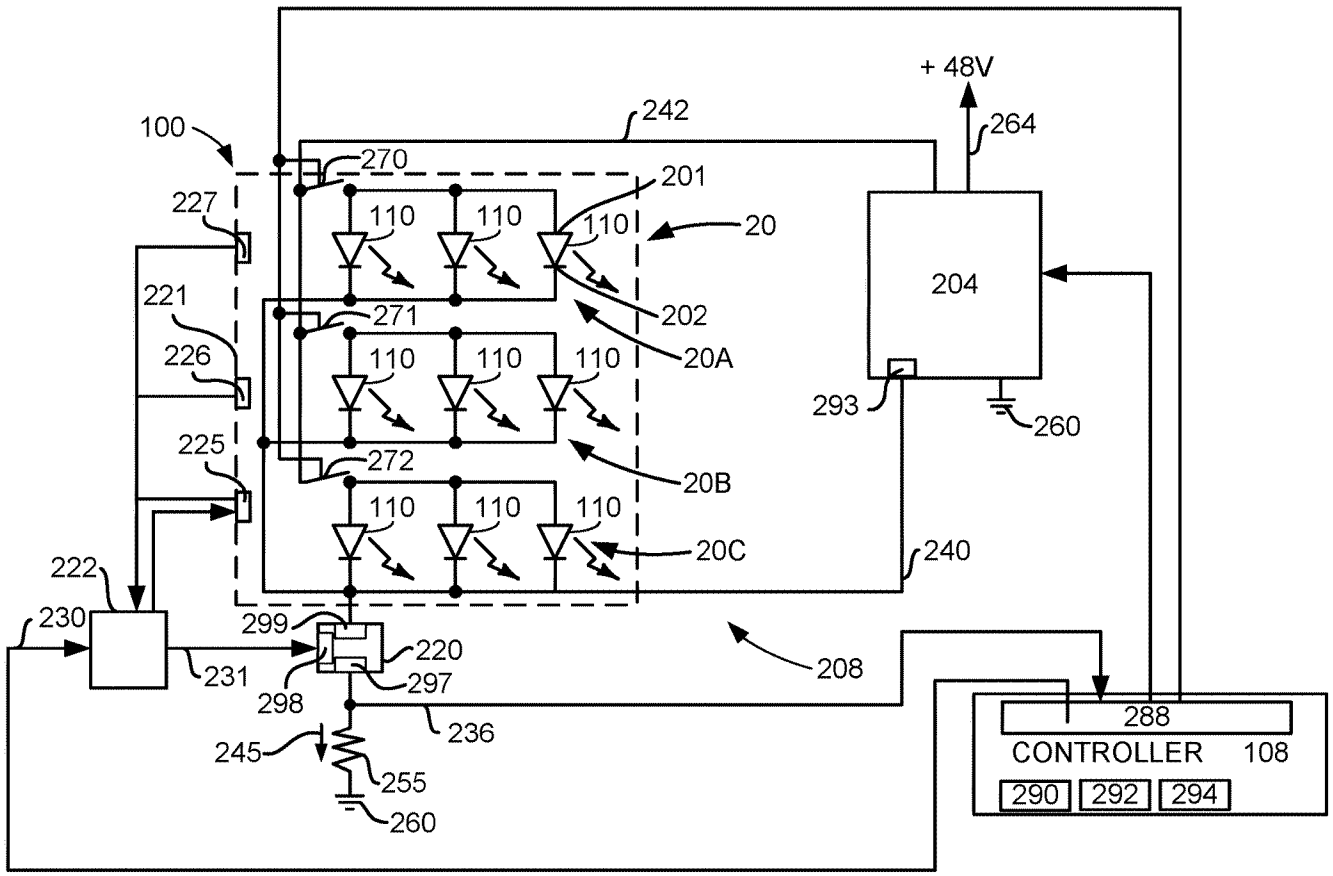
FIGS. 2 and 3 show schematics of an example lighting device irradiance control system.

The plurality of semiconductor devices 110 may be provided in the form of an array 20, or an array 20 may be comprised of multiple arrays (e.g., 20A, 20B, and 20C) as shown in FIG. 2. The array 20 may be implemented so that one or more, or most of the semiconductor devices 110 are configured to provide radiant output. At the same time, however, one or more of the array's semiconductor devices 110 are implemented so as to provide for monitoring selected of the array's characteristics. The monitoring devices 36 may be selected from among the devices in the array 20 and, for example, may have the same structure as the other, emitting devices. For example, the difference between emitting and monitoring may be determined by the coupling electronics 22 associated with the particular semiconductor device (e.g., in a basic form, an LED array may have monitoring LEDs where the coupling electronics provides a reverse current, and emitting LEDs where the coupling electronics provides a forward current).

Furthermore, based on coupling electronics, selected of the semiconductor devices in the array 20 may be either/both multifunction devices and/or multimode devices, where (a) multifunction devices are capable of detecting more than one characteristic (e.g., either radiant output, temperature, magnetic fields, vibration, pressure, acceleration, and other mechanical forces or deformations) and may be switched among these detection functions in accordance with the application parameters or other determinative factors and (b) multimode devices are capable of emission, detection and some other mode (e.g., off) and are switched among modes in accordance with the application parameters or other determinative factors.

Referring to FIG. 2, a schematic of a first lighting system circuit that may supply varying amounts of current to a lighting array is shown. Lighting system 100 includes one or more light emitting devices 110. In this example, light emitting devices 110 are light emitting diodes (LEDs). Each LED 110 includes an anode 201 and a cathode 202. Switching power source 102 shown in FIG. 1 supplies 48V DC power to voltage regulator 204 via path or conductor 264. Voltage regulator 204 supplies DC power to the anodes 201 of LEDs 110 via conductor or path 242. Voltage regulator 204 is also electrically coupled to cathodes 202 of LEDs 110 via conductor or path 240. Voltage regulator 204 is shown referenced to electrical ground 260 and may be a buck regulator in one example. Voltage regulator 204 selectively supplies electrical power to lighting array 20 comprised of independently controlled lighting arrays 20A, 20B, and 20C via switches 270, 271, and 272. Controller 108 is shown in electrical communication with voltage regulator 204 and switches 270, 271, and 272. Switches 270-272 provide independent control of lighting arrays 20A, 20B, and 20C. In other examples, discrete input generating devices (e.g., switches) may replace controller 108, if desired. Controller 108 includes central processing unit 290 for executing instructions stored in non-transitory memory 292. Controller 108 also includes inputs and outputs (I/O) 288 for operating voltage regulator 204 and other devices. Non-transitory executable instructions may be stored in read only memory 292 while variables may be stored in random access memory 294. Voltage regulator 204 supplies an adjustable voltage to LEDs 110.

Figure 3:
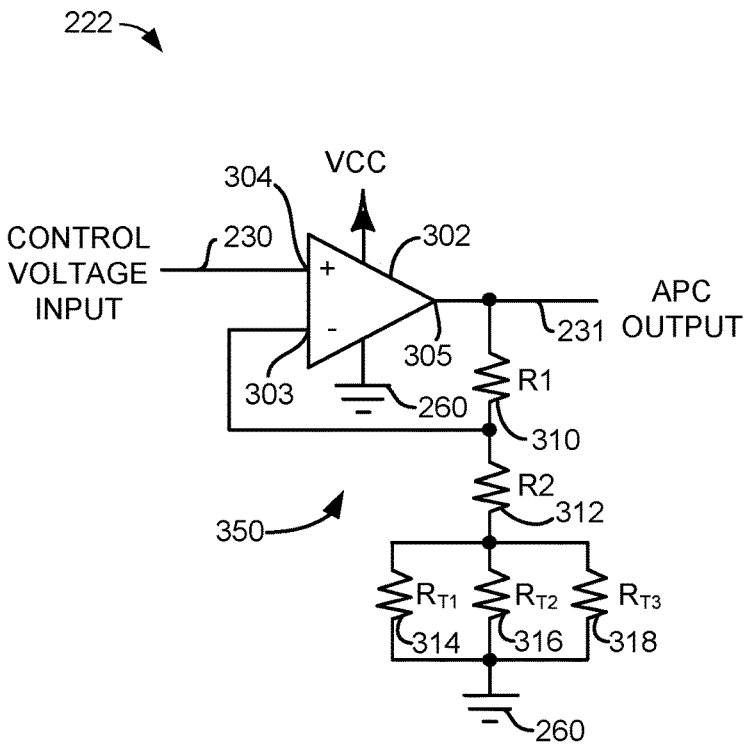

Variable resistor 220 in the form of a field-effect transistor (FET) receives an intensity or irradiance control signal voltage from controller 108 or via another input device from amplifier 222. Amplifier 222 supplies a control signal or output to FET gate 298 via conductor 231. Amplifier 222 receives an intensity or irradiance command from controller 108 at a non-inverting input as is shown in FIG. 3. Negative temperature coefficient devices (e.g., thermistor) 225, 226, and 227 are in a negative feedback loop or circuit of amplifier 222 as is shown in FIG. 3. Further, negative temperature coefficient devices 225, 226, and 227 are in thermal communication with LEDS 110 via heat sink 221. FET source 297 is electrically coupled to current sense resistor 255. While the present example describes the variable resistor as an FET, one should note that the circuit may employ other forms of variable resistors.

In this example, at least one element of array 20 includes solid-state light-emitting elements such as light-emitting diodes (LEDs) or laser diodes produce light. The elements may be configured as a single array on a substrate, multiple arrays on a substrate, several arrays either single or multiple on several substrates connected together, etc. In one example, the array of light-emitting elements may consist of a Silicon Light Matrix™ (SLM) manufactured by Phoseon Technology, Inc.

The circuit shown in FIG. 2 is a closed loop current control circuit 208. In closed loop circuit 208, the variable resistor 220 receives an intensity voltage control signal via conductor or path 231 via amplifier 222. Voltage between variable resistor 220 and array 20 is controlled to a desired voltage as determined by voltage regulator 204. The desired voltage value may be supplied by controller 108 or another device, and voltage regulator 204 controls voltage at conductor or path 242 to a level that provides the desired voltage in a current path between array 20 and variable resistor 220. Variable resistor 220 controls current flow from array 20 to current sense resistor 255 in the direction of arrow 245. The desired voltage may also be adjusted responsive to the type of lighting device, type of work piece, curing parameters, and various other operating conditions. An electrical current signal may be fed back along conductor or path 236 to controller 108 or another device that adjusts the intensity voltage control signal provided. In particular, if the electrical current signal is different from a desired electrical current, the intensity voltage control signal passed via conductor 230 is increased or decreased to adjust electrical current through array 20. A feedback current signal indicative of electrical current flow through array 20 is directed via conductor 236 as a voltage level that changes as electrical current flowing through current sense resistor 255 changes.

In one example where the voltage between variable resistor 220 and array 20 is adjusted to a constant voltage, current flow through array 20 and variable resistor 220 is adjusted via adjusting the resistance of variable resistor 220. Thus, a voltage signal carried along conductor 240 from the variable resistor 220 does not go to the array 20 in this example. Instead, the voltage feedback between array 20 and variable resistor 220 follows conductor 240 and goes to a voltage regulator 204. The voltage regulator 204 then outputs a voltage signal 242 to the array 20. Consequently, voltage regulator 204 adjusts its output voltage in response to a voltage downstream of array 20, and current flow through array 20 is adjusted via variable resistor 220. Controller 108 may include instructions to adjust a resistance value of variable resistor 220 in response to array current fed back as a voltage via conductor 236. Conductor 240 allows electrical communication between the cathodes 202 of LEDs 110, input 299 (e.g., a drain of an N-channel MOSFET) of variable resistor 220, and voltage feedback input 293 of voltage regulator 204. Thus, the cathodes 202 of LEDs 110 an input side 299 of variable resistor 220 and voltage feedback input 293 are at the same voltage potential.

The variable resistor may take the form of an FET, a bipolar transistor, a digital potentiometer or any electrically controllable, current limiting device. The drive circuit may take different forms depending upon the variable resistor used. The closed loop system operates such that an output voltage regulator 204 remains about 0.5 V above a voltage to operate array 20. The regulator output voltage adjusts voltage applied to array 20 and the variable resistor controls electrical current flow through array 20 to a desired level. The present circuit may improve production of a constant irradiance output from array 20. In the example of FIG. 2, the variable resistor 220 typically produces a voltage drop in the range of 0.6V. However, the voltage drop at variable resistor 220 may be less or greater than 0.6V depending on the variable resistor's design.

Referring now to FIG. 3, an example amplifier 222 for supplying an irradiance or intensity control voltage to a variable resistor that controls electrical current flow through a independently controlled lighting arrays is shown. Amplifier 222 includes an operational amplifier 302. A control voltage for outputting a desired irradiance or light intensity is input to amplifier 222 at non-inverting input 304. Amplifier 222 includes output 305 to operate variable resistor 220 shown in FIG. 2. Negative feedback loop 350 includes only two fixed value resistors (e.g., resistors that have resistance values that change by less than a predetermined percentage, 2% for example, dependent on a specified temperature range) including a first resistor (R1) 310 and second resistor (R2) 312. Negative feedback loop 350 also includes three negative temperature coefficient devices 314, 316, and 318 electrically coupled in parallel. In some examples, devices 314, 316, and 318 may be referred to as temperature dependent resistors so that negative feedback loop includes only five resistors. In this example, negative temperature coefficient devices 314, 316, and 318 each include a side that is directly electrically coupled to electrical ground 260. The first resistor (R1) sets the gain change from the minimum to maximum lighting array temperature. The second resistor (R2) sets a slope maximum to a predetermined lighting array equilibrium temperature. The values of R1 and R2 are adjusted to provide an equivalent gain for a feedback loop that includes only one negative temperature coefficient device and resistors R1 and R2 having different values than R1 and R2 shown in FIG. 3. In this way, a gain of amplifier 222 may be adjusted so that the circuit shown in FIG. 3 including three negative temperature coefficients may be similar to a circuit that includes only one negative temperature coefficient device.

Thus, amplifier 222 is a non-inverting amplifier that includes negative feedback in negative feedback loop 350. The inverting input 303 and non-inverting input 304 are very high impedance. Consequently, substantially no current flows into inverting input 303 or non-inverting input 304. The amplifier gain may be expressed as:

$$\frac{Vo}{Vin} = 1 + \frac{R1}{R2 + R_T}$$

where Vo is the output voltage of amplifier 222 at 305, Vin is the voltage at inverting input 303, R1 is the value of resistor 310, R2 is the value of resistor 312, and $R_T$ is equal to $1/(1/R_{T1}+1/R_{T2}+1/R_{T3})$ (e.g., $R_{T1}$-$R_{T3}$ are values of negative temperature coefficient devices shown in FIG. 3). Thus, if the lighting array temperature is cold and the value of $1/R_T$ is higher, the gain is closer to 1. If the lighting array temperature is warm and the value of $1/R_T$ is lower, the gain is closer to 1+R1/R2. If only one lighting array is active, the resistance of the negative temperature coefficient device associated with the active lighting array decreases as temperature of the active lighting array increases so that the gain moves closer to 1+R1/R2 than 1. Further, the lower resistance of negative temperature coefficient device associated with the active lighting array dominates the parallel resistance value so that amplifier gain is appropriate for the one active lighting array and less affected by the inactive lighting arrays and their corresponding negative temperature coefficient devices. In particular, amplifier gain for operating a single lighting array is within 2% of amplifier gain if all three lighting arrays shown in FIG. 3 were active and their respective negative temperature coefficient devices were at a same temperature. In this way, amplifier gain for operating only one lighting array may be substantially equal (e.g., within 2%) to amplifier gain for operating more than one lighting array. In some examples, the output of amplifier 222 may be referred to as an automatic power control (APC) command or signal.

It should be appreciated that the values of R1, R2, and $R_T$ may vary between different lighting systems. Additionally, the amplifier gain may be different in some embodiments without departing from the scope and intent of the present description.

Thus, the system of FIGS. 1-3 provides for a system for operating one or more light emitting devices, comprising: at least two independently controlled lighting arrays comprised of at least one light emitting device; and an amplifier including a negative feedback loop, at least two negative temperature coefficient devices electrically coupled in parallel and included in the negative feedback loop, each of the at least two negative temperature coefficient devices in thermal communication with one of the at least two independently controlled lighting arrays. The system includes where the amplifier is an operational amplifier, and further comprising a variable resistance device and a controller, the variable resistance device in electrical communication with a cathode side of the at least two independently controlled lighting arrays.

In some examples, the system includes where the at least two independently controlled lighting arrays are controlled via at least two switches. The system includes where at least one side of each of the at least two negative temperature coefficient devices is directly electrically coupled to an electrical ground. The system further comprises only two fixed value resistors in the negative feedback loop. The system includes where only one of the two fixed value resistors is directly coupled to the least two negative temperature coefficient devices. The system includes where the at least two negative temperature coefficient devices are in thermal communication with a heat sink, and where the at least two independently controlled lighting arrays are in thermal communication with the heat sink.

The system of FIGS. 1-3 also provides for a system for operating one or more light emitting devices, comprising: a lighting array comprised of at least one light emitting device; at least two negative temperature coefficient devices in thermal communication with the lighting array; and an amplifier including a negative feedback loop, the at least two negative temperature coefficient devices electrically coupled in parallel and included in the negative feedback loop. The system includes where one side of each of the at least two negative temperature coefficient devices is directly electrically coupled to an electrical ground. The system includes where the negative feedback loop provides electrical communication between an inverting input of the amplifier and an output of the amplifier. The system includes where the lighting array is comprised of at least two independently controlled lighting arrays, and where the at least two independently controlled lighting arrays are controlled via at least two switches. The system further comprises only two fixed value resistors in the negative feedback loop. The system includes where a first of the only two fixed value resistors is in direct electrical communication with an inverting input of the amplifier and an output of the amplifier, and where a second of the only two fixed value resistors is in direct electrical communication with the first of the only two fixed value resistors, the inverting input of the amplifier, and the at least two negative temperature coefficient devices.

Figure 4:
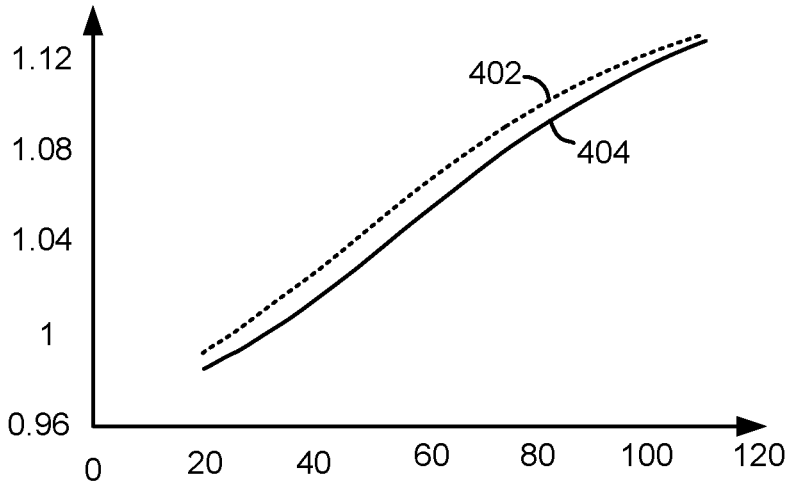
FIG. 4 shows a plot of amplifier gain for systems where one of three lighting arrays is activated and where three of three lighting arrays are activated.
Figure 5:
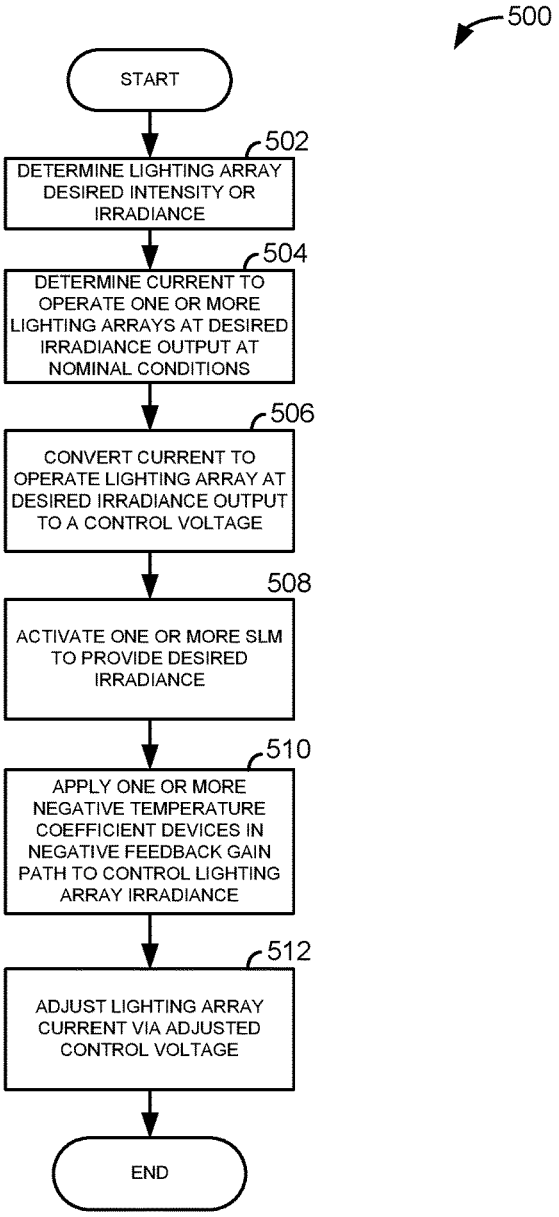
FIG. 5 shows an example method for controlling irradiance in a lighting system.

Referring now to FIG. 4, a plot of amplifier gain for the amplifier 222 in FIG. 3 is shown. The vertical axis represents amplifier gain and amplifier gain increases in the direction of the vertical axis arrow. The horizontal axis represents a temperature of a heat sink in thermal communication with one or more lighting arrays and one or more negative temperature coefficient devices. The temperature increases from the left side of FIG. 4 to the right side of FIG. 4.

Curve 402 represents amplifier gain for when three independently controlled lighting arrays of a photoreactive system are activated and feedback from three negative temperature coefficient devices is provided to amplifier 222 shown in FIG. 3. Curve 404 represents amplifier gain for when one independently controlled lighting array of the photoreactive system is activated and feedback from three negative temperature coefficient devices is provided to amplifier 222 shown in FIG. 3. The heat sink may exhibit a 20° K temperature difference from one end of the heat sink to the other end of the heat sink when only one lighting array is activated. The amplifier gains of curves 402 and 404 are within 2%. Thus, amplifier 222 may control irradiance output of a single lighting array nearly equivalent to the way amplifier 222 controls irradiance output of three lighting arrays. Consequently, a single amplifier may be used to control two or more lighting arrays, where in the past, two or more amplifiers would have been used. Further, amplifier 222 provides substantially a same gain (e.g., within 2%) operating a single lighting array as when operating more than one lighting array.

Referring now to FIG. 5, an example method for controlling lighting array electrical power and irradiance is shown. The method of FIG. 5 may be included as instructions stored in non-transitory memory of a controller as shown in FIGS. 1 and 2.

At 502, lighting array desire intensity or irradiance is determined. The desired intensity may vary from lighting system to lighting system and from work piece to work piece. In one example, the desired intensity may be determined from a control parameter file or an operator may manually select the desired intensity or irradiance level. The control parameter file may include empirically determined values of irradiance for the lighting array. Method 500 proceeds to 504 after the lighting array irradiance or intensity is determined.

At 504, method 500 determines current and/or power to operate the lighting array at the irradiance level determined at 502. In one example, lighting array power may be determined via indexing a function or table of that includes empirically determined current or power levels that may be indexed via the desired irradiance. The table or function outputs the desired lighting array current and/or power and proceeds to 506.

At 506, method 500 converts the desired current or power into a control voltage or current for operating the variable resistor that controls current flow through the lighting array. In one example, method 500 passes the desired current or power value through a transfer function to determine a lighting array irradiance command. The irradiance command may be in the form of a voltage or a value of a parameter. Method 500 proceeds to 508 after the irradiance command is determined.

At 508, method 500 activates one or more SLMs or lighting arrays to provide the desired irradiance. In one example, one or more lighting arrays may be activated by closing a switch for each lighting array to be activated. One switch controls current flow to one lighting array such that if five lighting arrays are to be activated, five switches are closed. The number of lighting arrays to be activated may be dependent on the irradiance level requested and/or the test piece configuration. Method 500 proceeds to 510 after one or more lighting arrays are activated.

At 510, method 500 applies one or more negative temperature coefficient devices or transfer functions in a negative feedback loop of an amplifier (e.g., amplifier 222 of FIG. 2) that supplies a control voltage or current to a variable resistor.

In one example, the one or more negative temperature coefficient devices may be included in a negative feedback loop of an amplifier as shown in FIGS. 2 and 3. The negative temperature coefficient devices adjust a gain of the amplifier as a temperature of the lighting arrays change as reflected in a temperature change of a heat sink that is in thermal communication with the lighting arrays. In one example, the gain of the amplifier is as described in FIG. 4. The control voltage determined at 506 is applied to a non-inverting input of the amplifier.

In another example, voltages or resistances representing temperatures of the lighting arrays are input to a controller and the voltages or resistances are directed through a transfer function that converts the voltages or resistances into negative temperature coefficient output parameters. For example, if a voltage is input to the controller that represents a lighting array temperature, the voltage is converted to a resistance value such that the resistance value decreases in response to an increasing lighting array temperature. The resistance values may then be applied to a transfer function representing an amplifier having one or more negative temperature coefficient devices in its negative feedback path. For example, the controller may implement the amplifier shown in FIG. 3 and its transfer function in the form of a digital filter stored in memory. The control voltage determined at 506 is applied to the digital filter. Method 500 proceeds to 512 after the negative temperature coefficient are applied to a negative feedback path of an amplifier that adjusts lighting array current and\or power.

At 512, method 500 adjusts lighting array current and/or power via supplying a current or voltage to a variable resistor. In one example, the current or power may be adjusted via an amplifier as is shown in FIG. 3. In another example, the current or power may be adjusted via a controller supplying a current or voltage from an analog output, the current or voltage determined from output of the digital filter described at 510.

Thus, the method of FIG. 5 may be implemented via a digital controller or an analog circuit. The method applies negative temperature coefficients to a negative feedback path of an amplifier to maintain lighting array irradiance at a constant level in the presence of varying lighting array temperatures of one or more independently controllable lighting arrays.

The method of FIG. 5 provides for a method for operating one or more light emitting devices, comprising: sensing temperatures at two or more locations on a thermal conductor, the thermal conductor in thermal communication with a lighting array, the temperatures at the two or more locations sensed via two or more negative temperature coefficient devices electrically coupled in parallel; and adjusting current flow through the lighting array in response to output of a controller that includes the two or more negative temperature coefficient devices in a negative feedback loop. The method includes where each of the two or more negative temperature coefficient devices include a side that is electrically coupled directly to an electrical ground.

In some examples, the method includes where the current flow through the lighting array is adjusted via an operational amplifier. The method includes where the current flow through the lighting array is adjusted via instructions in the controller. The method includes where the lighting array is comprised of at least two independently controlled lighting arrays. The method includes where the at least two independently controlled lighting arrays are controlled via at least two switches. The method includes where the current flow is adjusted to provide a substantially constant irradiance output from the lighting array.

Note that the example control and estimation routines included herein can be used with various lighting system configurations. The control methods and routines disclosed herein may be stored as executable instructions in non-transitory memory and may be carried out by the control system including the controller in combination with the various sensors, actuators, and other lighting system hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the lighting control system, where the described actions are carried out by executing the instructions in a system including the various lighting system hardware components in combination with the electronic controller.

This concludes the description. The reading of it by those skilled in the art would bring to mind many alterations and modifications without departing from the spirit and the scope of the description. For example, lighting sources producing different wavelengths of light may take advantage of the present description.

The invention claimed is:

1. A system for operating one or more light emitting devices, comprising:

a lighting array comprising at least one light emitting device;

at least two negative temperature coefficient devices in thermal communication with the lighting array; and an operational amplifier including a negative feedback loop, the at least two negative temperature coefficient devices electrically coupled in parallel to each other and coupled to the negative feedback loop, only two fixed value resistors coupled to the negative feedback loop, and where a first of the only two fixed value resistors is in direct electrical communication with an inverting input of the operational amplifier and an output of the operational amplifier, and where a second of the only two fixed value resistors is in direct electrical communication with the first of the only two fixed value resistors, the inverting input of the operational amplifier, and the at least two negative temperature coefficient devices.

2. The system of claim 1, where one side of each of the at least two negative temperature coefficient devices is directly electrically coupled to an electrical ground.

3. The system of claim 1, where the lighting array comprises at least two independently controlled lighting arrays, and where the at least two independently controlled lighting arrays are controlled via at least two switches.

* * * * *